United States Patent [19]
Pari
[11] 4,041,655
[45] Aug. 16, 1977

[54] TELESCOPING SEATING SYSTEMS

[75] Inventor: Vincent Anthony Pari, Muskegon, Mich.

[73] Assignee: Universal Bleacher Company, Champaign, Ill.

[21] Appl. No.: 708,607

[22] Filed: July 26, 1976

[51] Int. Cl.[2] ..... E04H 3/12
[52] U.S. Cl. ..... 52/9; 52/646
[58] Field of Search ..... 52/9, 183, 645, 646, 52/7, 10

[56] References Cited

U.S. PATENT DOCUMENTS 3,279,131 10/1966 Curra, Jr. ..... 52/9 X

*Primary Examiner*—Price C. Faw, Jr.
*Assistant Examiner*—Carl D. Friedman
*Attorney, Agent, or Firm*—Tilton, Fallon, Lungmus, Chestnut & Hill

[57] ABSTRACT

A telescoping seating system has a plurality of row assemblies which may be extended for use or retracted to nested relation for storage. Each row assembly includes a pair of floor wheel channels. A post is mounted to each wheel channel; and a deck (which may include a riser beam) is connected between the tops of the posts. The invention enables the understructure configuration of all row assemblies to be similar. In a preferred form, the posts extend upwardly and they are inclined inwardly so that all posts on each side of the structure are parallel, and the connection between the posts and decks are in vertical alignment on each side. Thus, all row assemblies have a uniform center span. End cantilever spans beyond the posts are also equal for all row assemblies. Since the post/deck connections are the same for each row, all deck elements, such as risers, tread panels and seatboards are interchangeable; and they can be manufactured with uniformly spaced holes for fasteners, thereby facilitating manufacture and obviating any need to sort them when the structure is being erected on site.

22 Claims, 18 Drawing Figures

TELESCOPING SEATING SYSTEMS

BACKGROUND AND SUMMARY

The present invention relates to telescoping seating systems; and more particularly, it relates to improvements in row assemblies for telescoping seating systems.

A telescoping seating system includes a number of row assemblies which may be extended for use or retracted for storage. In the use position, the row assemblies are arranged in tiered or stepped relation. In the storage position, the row assemblies are arranged in superposed relation—i.e., a lower row is nested beneath the next higher row. Such telescoping seating systems are used in gymnasiums, auditoriums and the like; and they may have seating arrangements of the bleacher type, such as are disclosed in co-owned U.S. Pat. Nos. 3,667,171 and 3,768,215, or they may be of the platform and individual folding chair type such as is disclosed in co-owned application Ser. No. 349,959, of Vance, et al, filed Apr. 11, 1973. The present invention may be adapted to either the bleacher type of seating arrangement or the chair platform type, as will be disclosed below. Other seating structures may be found in U.S. Pat. Nos. 2,898,639, 3,335,533, 3,107,398, 3,107,399, 3,222,827, 3,478,473, 3,748,798, and 3,768,215.

In general, each row assembly includes posts which are mounted to floor-engaging wheel carriages or channels. The tops of the posts for each row are connected together to form a rigid frame or understructure by a deck which may include a riser beam or, in the case of low-rise platforms, a tread panel frame.

As used herein, the word "telescope" thus refers to seating systems of the type in which individual row assemblies may be moved to a nested position beneath a next higher row, so that the wheel channels are moved side-by-side in the retracted position and the overall depth of the system when retracted may be made equal to the depth of a single row. This is to be distinguished from some prior systems, in which the wheel channels are aligned in front of one another. The latter systems, of course, have limitations on the depth of the system when retracted for storage.

Typically, in prior systems, a pair of posts support a single row section, and they have been arranged to be vertical. For telescoping systems, the wheel carriages (and, hence, the posts) are located progressively further out from the center of the row for the higher rows so that all of the carriages will nest into side-by-side relation when the system is telescoped into the storage position. In some systems, a riser member or beam is connected by fasteners such as bolts to the top of a pair of posts for each row; and the tread panel or platform is supported by support arms or cantilever members connected to and extending outwardly from the riser beam. In other systems, as mentioned, a rigid frame is used for the deck and it is directly connected to the posts. The tread panels may or may not form a structural element of such a deck.

Because the posts in the prior art structures are vertical and spaced at different intervals from row to row, the center span and cantilever span varies from row to row so that materials have to be strengthened and structure added in order to account for the "worst case" spans for all rows. Further, in these structures it has been necessary to form apertures in the riser members and cover materials (such as tread panels and seat boards) for attaching bolts at varying distances during manufacture, thereby requiring that each row, in effect, have a unique design. This problem is further troublesome because the telescoping seating systems are shipped from a manufacturer to a job site in disassembled condition. Thus, workmen at the site must sort out and group associated riser beams, posts, bracing, and cover materials. Bracing between the riser beams and posts or columns of the prior art normally varies according to whether a given row is one of the lower rows, one of the intermediate rows or one of the upper rows, as will be discussed more fully within.

In a preferred form of the present invention, all row assemblies have similar ' deck/support post configurations'. By this is meant that the included angles between the post and the horizontal plane of the tread panel of all the row assemblies are equal and the included angles between the posts and the floor are equal, the only differences in such configurations being that the posts are different lengths depending upon the position of the row in the system. Looking from the front or back, the axis of the post intersects with the horizontal plane of the tread panel. These intersections are vertically aligned at each side of the rows so that the center span for all rows is the same. Each of the 'deck/support post configurations' define with the floor an isoceles trapezoid, and the angles of any one of such trapezoids is equal to the other corresponding angles of the other trapezoids.

This is accomplished in the illustrated embodiment by orienting the posts to an off-vertical position. Specifically, the posts for each row are inclined inwardly (i.e., toward each other) in a uniform manner. Thus, all posts on either side of the structure are parallel. The connections between the posts and their associated decks (i.e., the deck/post connections) are in vertical alignment for each side of the system. Thus, all decks have the same distances between connections to posts and the bolt aperture are at the same locations for each riser, seat board and tread panel. This on-line hole location permits uniform fabrication of risers and cover materials at the manufacturers's site, and obviates the need to code them during manufacture or to sort them during installation.

The present invention has still another important advantage: because the distance between deck/post connections is the same for all row assemblies, the simple beam loading or "center span" as well as the end loading or "cantilever span" is the same for all rows. It will be observed that the center span is determined by the location of attachment to the posts, not necessarily to the decks if intermediate members or brackets are used to make the connection. This permits the elimination of secondary members to support the center span as the wheel carriages become spaced further apart, as required in the prior art. Simple tension members extending between the posts may be employed. Such tension members may take the form of flat steel straps, as distinguished from the heavy angle-iron compression members used as secondary support members in prior designs.

Because the spacing of wheel carriages with the present invention is the same as for the corresponding row of a prior art system having similar rise and span, the same safety precautions are available to prevent overturning or resist sway under similar loading. It is believed that resistance to side sway is even improved with the present design, as will be discussed within.

There are retractable seating structures in the prior art which achieve a constant span, but these are not "telescoping" systems within the strict meaning of that term as defined herein. Such prior systems are referred to herein as "folding" seating systems. In such folding systems the posts are aligned in the fore-and-aft direction (i.e., parallel to the direction in which the rows are moved for use); and the wheel carriages are offset relative to wheel carriages for adjacent rows to avoid interference with each other. Such systems obviously do not retract to a depth which is equal to the depth of a single row, as is the case in telescoping seating systems (because the posts assume a side-by-side relation in the nested position). This is so in the case of folding systems because the posts are forwardly aligned in the manner described; and they would interfere with one another.

Some telescoping systems have also achieved on-line drilling of holes in the risers and cover materials with vertical posts. In these systems, brackets are used to interconnect the posts with a row support frame. A bracket is connected to all row support frames at the same locations, but the posts are located progressively outwardly for higher rows and the brackets are provided with a number of post connection locations to accommodate the variation in spacing as the posts are spaced increasingly further apart. Thus, even though constant spacing for hole drilling is achieved, the structural shortcomings of the prior art are still present—namely, a variation in center span and cantilever span.

In its broader aspects, then, the present invention is directed to a telescoping seating structure which has a similar deck/support post configuration in all rows. This uniformity facilitates manufacture and assembly (by permitting on-line hole-drilling in risers and cover materials), and achieves a constant center span for all rows.

Once a uniform deck/support post configuration is achieved, the internal stresses on the structure are the same for all rows —that is, the elements of the structure carry the same load (for the same loading conditions) irrespective of the position of the row in the system. This obviously was not true in prior telescoping seating systems of varying center span, such as has been discussed.

It is known that a desirable design in a theoretical sense would have one-half the length of a row in the center span and one-quarter of the length in each of the cantilever spans. This is also made possible for all rows with the present invention.

Other features and advantages of the present invention will be apparent to persons skilled in the art from the following detailed description of a preferred embodiment accompanied by the attached drawing, wherein identical reference numerals will refer to like parts in the various views.

THE DRAWING

FIG. 1 is an upper perspective view of a telescoping bleacher system constructed according to the prior art;

FIGS. *2a* - *2c* are rear diagrammatic views of the understructure of row assemblies in the prior art, illustrating respectively an upper, intermediate and lower row assembly;

FIGS. *3a* - *3c* are rear views of understructures for rows of the present invention, showing respectively upper, intermediate and lower rows;

FIG. *3d* is a diagrammatic view showing the relationship between the inclination of the posts, the rise of the system and the wheel channel spacing for the system of FIGS. *3a* - *3c*.

DETAILED DESCRIPTION

Figure 1:
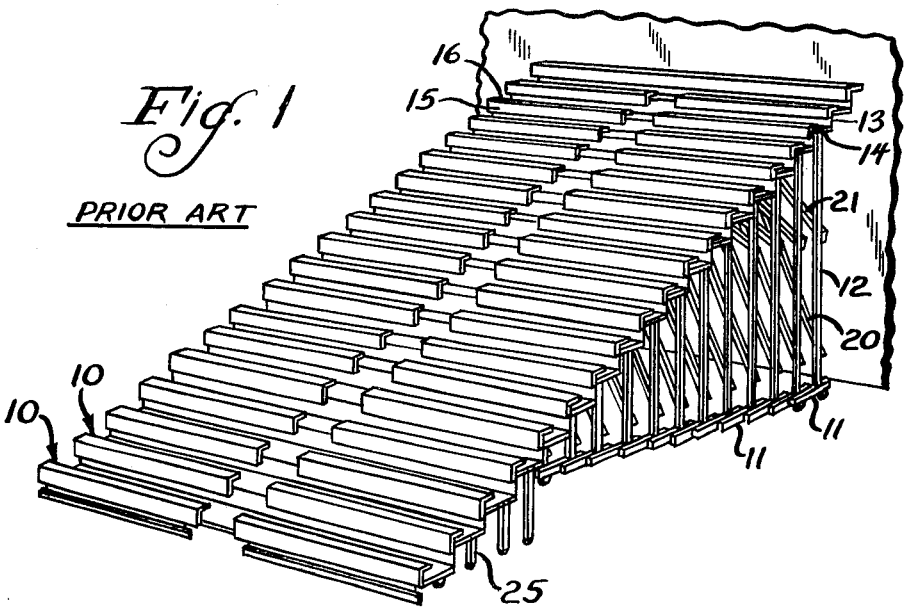
Fig. 1 PRIOR ART

Referring to FIG. 1, there is shown a seating system of the type known in the prior art and employing bleacher-type seating. The systems includes 18 individual movable row assemblies (or simply "rows" ) generally designated 10, and it is constructed according to the teachings of U.S. Pat. No. 3,667,171. Each of the rows includes a pair of side wheel carriages, the ones on the right being illustrated and designated 11. Extending vertically from the wheel carriages 11 are posts 12. The top of the posts 12 are connected to riser members or beams 13. These beams 13 may be a C-shaped channel having a lower flange which supports the rear edge of an associated tread panel 14. Forward risers 15 are provided at the forward end of each row section, and rearwardly extending seat panels 16 are located at the top of the forward risers 15.

Each row includes cantilever arms 17 (see FIG. *2a*) extending forwardly of the top of associated vertical posts 12, and support arms 18 which are spaced along the longitudinal direction of a row and are connected to the rear of the riser 13. These cantilever arms 17 and support arms 18 (designated respectively 50 and 51 in FIG. 6) extend forwardly, supporting the tread panel and thence upwardly and rearwardly at the forward end, providing means to which both the forward riser 15 and the seat panel 16 are secured.

As can be seen from FIG. 1 and from a comparison of FIG. *2a*, *2b* and *2c*, the wheel carriages 11 are spaced progressively outwardly for each higher row. Referring particularly to FIGS. 1 and *2a*, it will be observed that the posts 12 are located further and further apart in the higher rows. This requires additional braces or members 20 extending between the lower sections of the posts 12 and the center of the riser 13. These extra braces take the form of heavy angle irons because they are required to support compressive loads, and they therefore induce bending moments in the riser under such loads.

In the uppermost rows (for example, in systems having 30 rows) still further braces 21 are added extending from an intermediate location of the posts 12 to the central portion of the riser 13. The function of the braces 21 is to resist buckling of the posts 12 under loading. Under vertical load, these members also bear compressive loads and therefore induce a bending moment in the riser 13.

In the intermediate or lower rows, as represented in FIG. *2b,* the spacing of the posts 12 is closer, but there are included the compressive braces 20, although the upper braces 21 are omitted.

In the lowermost rows of the prior art, as represented in FIG. *2c,* the posts 12 are still closer together, the braces 20 are included, and there are also included side or wing supports 25 for the additional cantilever span. These take the form of additional posts, similar to the posts 12, and additional wheel carriages 26. As seen in FIG. 1, the wing columns 25 are provided in the four lower rows.

Comparing FIGS. *2a, 2b* and *2c,* a center or free span is designated respectively S, S′ and S″ for the three rows. The center span for a riser type of deck construction comprises a simple beam supported at each end—in this case, by direct connection to the posts 12—and it is defined by the spacing of the deck/post connections. A "deck/post connection" means the location at which the connection is made to the post. Thus, if an intermediate member such as a bracket were used, the connection to the post, not to the riser or other portion of the deck is important in a structural sense because it is this connection that determines the center and cantilever spans, as well as the deck/support post configuration. In FIGS. *2a* and *2b,* a side or cantilever span is designated respectively C and C′, and this cantilever span extends from a deck/post connection to the free end of the deck.

Comparing the three drawings, it will be observed that the center span increases progressively from a lower row to an upper row, whereas the cantilever span decreases correspondingly. This is caused, of course, by the increased spacing of the vertical posts.

Turning now to FIG. *3a,* a riser is again designated 13, and the wheel carriages are shown at 11. Posts or columns extending from the wheel carriages 11 and connected at their upper ends to the riser 13 are designated 28 and 29 respectively. The posts 28, 29, it will be observed, are inclined toward each other, and the angle of inclination relative to the horizontal is designated Θ in FIG. *3c.*

A first brace extends from the lower section of the right post 29 to the deck/post connection at the top of post 28. Similarly, a brace 31 extends from the lower section of the left post 28 to the deck/post connection at the top of post 29. The upper ends of the braces 30, 31 may be directly connected either to the posts 28, 29 respectively or to an adjacent location on the riser or other deck location, as will be more fully described below.

An intermediate row, as seen in FIG. *3b,* has a deck-/support post configuration similar to that of a higher row except that the posts are shortened, obviously. However, the included angle between a post and a riser remains the same. In order to have all the deck/post connections for each side in vertical alignment, the angle of inclination Θ (i.e., the included angle between a post and the floor) is related to the rise of the seating system. The "rise" is the vertical distance between two corresponding points on adjacent rows, such as the vertical distance between tread panels or seat boards. This will be more fully understood in reference to FIG. *3d.*

Comparing FIGS. *3a, 3b* and *3c,* it can be seen that the deck/post connections on each side are in vertical alignment so that the center span S (i.e., the distance between deck/post connections) as well as the cantilever span C is the same for all rows. With this structure, then, the span can be made equal to one-half the length of a row; and the cantilever spans can each be one-quarter of the row length (which is taken to be the side-to-side dimension in FIG. *3a*).

It will thus be appreciated that in the present system, all row assemblies have a similar understructure configuration and provide a uniform center span. This results in having each element carrying the same load under similar loading conditions from row to row.

It will also be appreciated that the drilling of holes in the riser beam 13 is the same for all rows in the present system and this can be done using a single template or measurement, thereby greatly facilitating manufacture and obviating the need to sort risers (as well as cover materials) according to row after shipping and prior to installation. This feature obviates the need for separate measurements (with the resulting greater likelihood of error) for each row, as required in prior constructions discussed.

Referring now to FIG. *3d,* the axis of the right side inclined posts 29 is indicated by the line 29A, and the wheel carriages are diagrammatically indicated by reference numeral 11A for two adjacent row sections. The axes 29A of all posts on the right side are parallel, and they define an included angle with the horizontal indicated by Θ. In FIG. *3d,* the symbol "*a*" the center-to-center spacing for adjacent wheel channels, and "*r*" indicates the rise of the system, as defined above. Thus, the angle Θ is defined by the following relationship:

$$\tan \theta = \frac{r}{a}$$

In one particular embodiment given here as an example, where the row-to-row rise is 10½ inches and the center-to-center spacing of the wheel channels is 2½ inches, the angle of inclination of the posts relative to the horizontal (the angle Θ) is approximately 78°. A preferred range for the angle Θ) is 75° – 82°, again depending upon the rise and the center-to-center spacing of the wheel channels.

Figure 5:
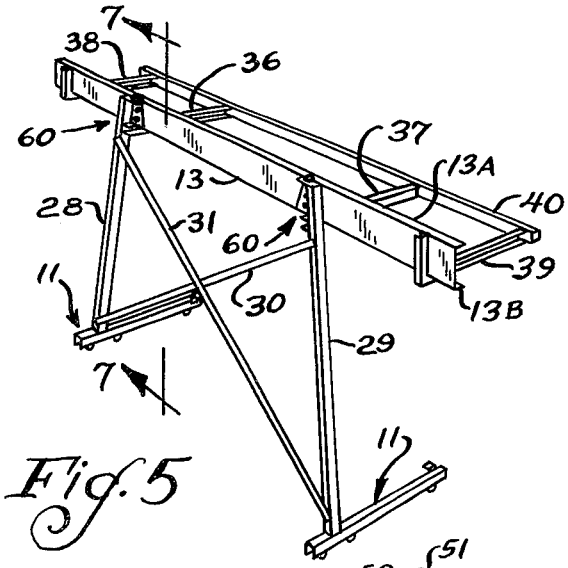
FIG. 5 is an upper, right, rear perspective view of a chair-platform row incorporating the present invention.
Figure 11:
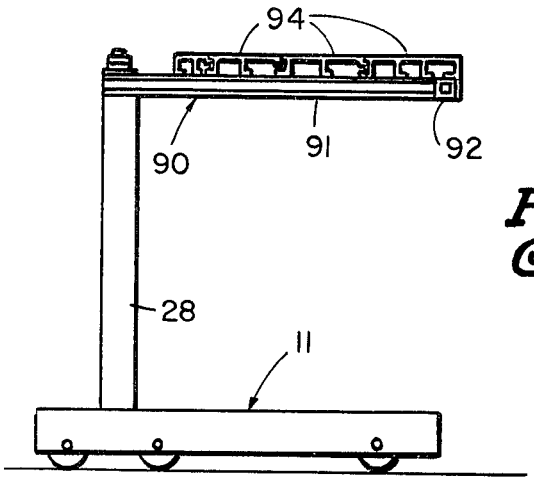
FIG. 11 is a transverse side view of a row for a low-rise platform constructed according to the present invention.

Turning now to FIG. 5, there is shown the understructure for a row assembly which may be used for chair platforms of normal rise (a low-rise platform is shown in FIG. 11). Again, the wheel carriages are designated 11, and the inclined posts are designated respectively 28 and 29. Sway bracing between posts is provided by the tension members 30, 31. A riser beam designated 13 is connected between the upper ends of the posts 28, 29. The riser beam 13 includes an upper flange 13A and a lower flange 13B. Cantilever support arms 36, 37 are connected to the posts 28, 29 and extend forwardly thereof for supporting the weight of the tread panel and chairs in the stored position. At the outboard ends of the riser 13, and connected to the back thereof are support arms 38, 39. These arms may be channel members, as illustrated, or tubes. At the forward ends of the cantilever arms 36, 37, as well as the forward ends of the support arms 38, 39, there is attached a forward transfer member 40 which extends the full length of the row.

In this embodiment, the rear edge of the tread panel (not shown) is continuously supported by the lower flange 13B of the riser 13, and the forward edge of the tread panel is continuously supported by the upper flange of riser 13 through the forward transfer member 40 in the use position.

Figure 4:
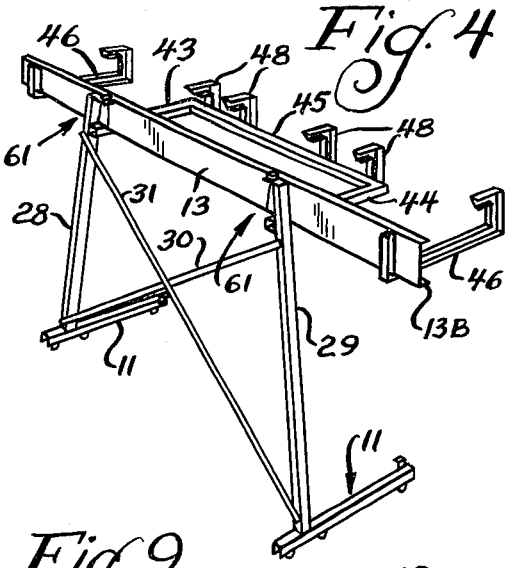
FIG. 4 is an upper, right rear perspective view, of a frame for a bleacher row incorporating the present invention.

Turning now to FIG. 4, there is shown a row assembly for a seating system incorporating the present invention and adapted to provide bleacher seating. The wheel carriages are again designated 11, the rear riser beam 13, the inclined posts 28, 29 respectively, and the braces again 30, 31.

In this embodiment, forward cantilever arms 43, 44 are welded adjacent the top of the post 28, 29 and a forward support member 45 is welded between the distal ends of the cantilever arms 43, 44. A pair of side support arms 46, similar to the support arms of the above-identified U.S. Pat. No. 3,667,171 are secured to the rear of the riser beam 13. A plurality of L-shaped supports 48 are provided at the forward end of the support member 45. The forward L-shaped ends of the support arms 46 as well as the L-shaped support members 48 provide means for mounting a forward riser member and a seat panel to provide seating in bleacher fashion, and a tread panel is supported by the cantilever arms 43, 44, the support arms 46 and the lower flange 13B of the rear riser 13.

Figure 6:
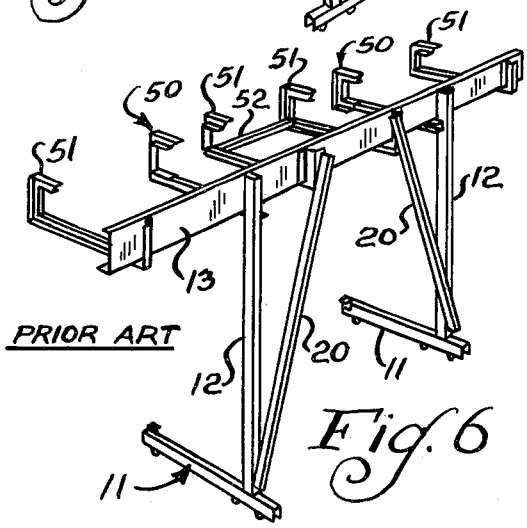
FIG. 6 is an upper, left rear perspective view of a bleacher row constructed according to the prior art.

FIG. 6 shows a supporting understructure for a row assembly according to the prior art, for rows of intermediate height. The wheel channels are designated 11, the vertical upright posts 12, and a riser beam 13. Two cantilever arms 40 are connected respectively to the upper portions of the posts 12; and four support arms 51 are connected to the back of the riser 13. A spacer 52 is connected between the lower, distal ends of the two center support arms 51. In this embodiment, the braces 20 are connected to the rear of the riser 13 immediately behind the two center support arms 51.

In FIG. 11, the present invention is adapted to a low rise platform such as is sometimes used to provide platform seating. Here, a pair of wheel carriages and inclined posts (only one of which is seen at 28) is provided with a deck means generally designated 90 which does not include a channel-shaped rear riser beam due to the low rise. Rather, a frame including cantilever arms 91 are connected directly to the posts and a front cross beam 92 welded to the distal ends of the arms 91 provides the deck. All of the structural elements of the deck provide the structural integrity. A tread panel of extruded elements 94 is supported by the frame of the deck.

Comparing now the understructures shown in FIGS. 4, 5 and 11 with that of the prior art shown in FIG. 6, the structures of FIGS. 4, 5 and 11 have similar deck-/support post configurations for all rows, whereas the spacing of post connections for the embodiment of FIG. 6 varies with the height of the row (i.e., its position in the system). In other words the intersections of the axes of the posts with the horizontal plane of the tread panel are vertically aligned for each side of all rows. The only members in FIGS. 4, 5 and 11 which are intended to, or in fact do carry compressive loads from the tread panels or seats are the inclined posts 28, 29. The braces 30, 31 do not carry compressive loads, but rather, they are forced into tension whenever a load is applied to the tread panel, seat board or riser carried by the posts. Further, as has already been pointed out, the center span between the deck/post connections (designated 60 in FIG. 5 and 61 in FIG. 4) remains constant, whereas the center span for the structure of FIG. 6 increases as the height of the row increases. In summary, with the present invention, the deck/support post configuration is similar for all rows; the inclined posts are the only support members bearing compressive loads under normal vertical loading; and the angle of inclination of the posts is such that there is a uniform center span and cantilever span for all rows.

As mentioned, it is known that in supporting a beam in this manner, under uniform loading, the length of the cantilever portion at either end can be approximately one-half the distance of the center span. By having constant center span distances, the design can be optimized in the sense that one does not have to account for the worst-case loading in both center span and cantilever in the same design. In other words, the center span can be one-half the length of the row, and the cantilever spans can each be one-quarter of the length.

Figure 2A:
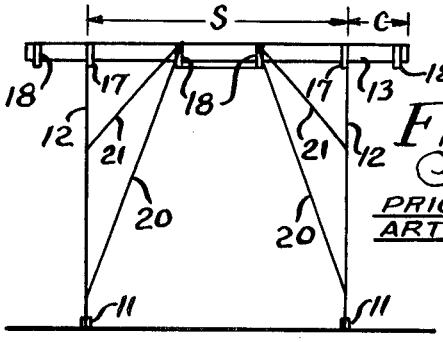
Fig. 2a PRIOR ART
Figure 3A:
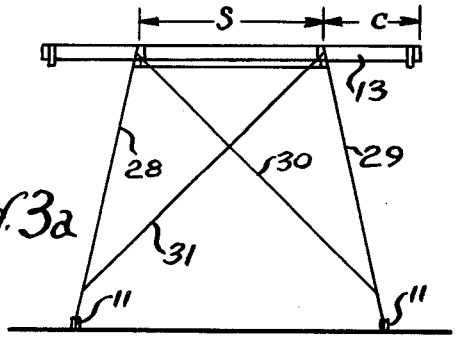
Figure 2B:
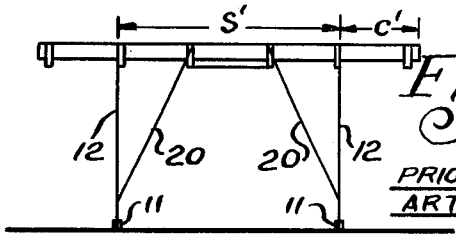
Fig. 2b PRIOR ART
Figure 3B:
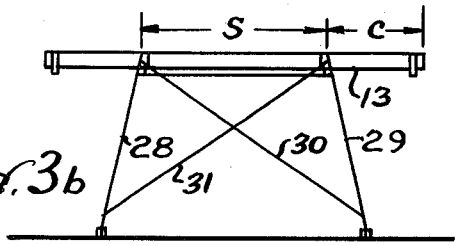
Figure 2C:
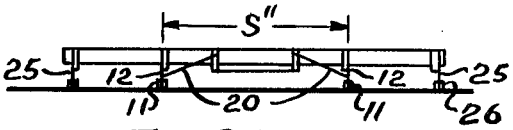
Fig. 2c PRIOR ART
Figure 3C:
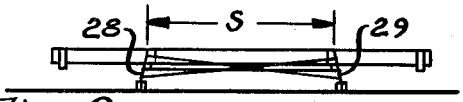
Figure 3D:
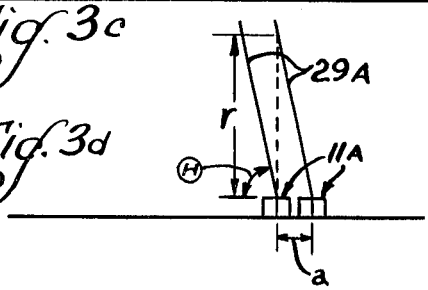

Another advantage of the present invention concerns its ability to resist side-sway loads—that is, a resistance to lateral deflection in response to a purely lateral force (parallel to the plane of the page of FIGS. **2*a* or 3*a*). In the case of the structure of FIGS. 2*a* and 6, side-sway is resisted at an upper connection between the riser and upright posts, whereas in the structures of FIGS. 3*a*, 4, 5 and 11, the resistance to side-sway is encountered at the wheel carriage which is better able to resist such loads. Further, under sway load conditions, the present invention introduces only compressive loads in the riser beams, whereas the structures of FIGS. 1 and 6** introduce both compression and bending.

Figure 7:
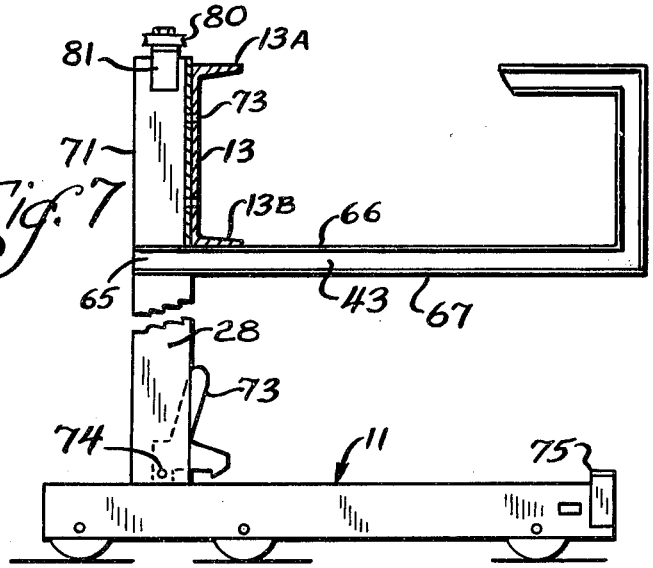
FIG. 7 is a transverse cross sectional view taken along the section line δ—7 of FIG. 5.
Figure 8:
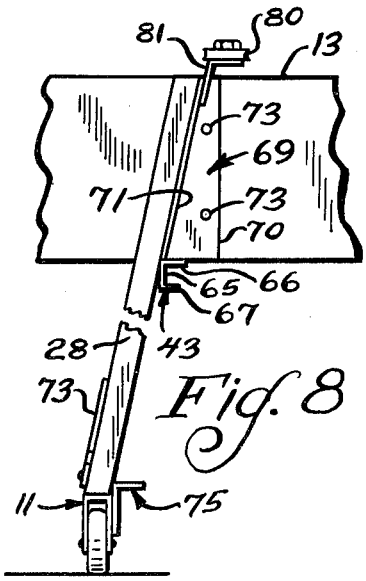
FIG. 8 is a fragmentary, close-up rear view of the left side of a row incorporating the present invention with the center portion of the post broken away.

Turning now to FIGS. 7 and 8, the cantilever support arm 43 may take the form of a generally C-shaped channel member having a web 65, an upper horizontal flange 66, and a lower horizontal flange 67. The web 65 is welded to the post 28 at its upper edge and a second weld is employed at an intermediate location to provide a moment-resisting connection. Above the cantilever arm 43 is a bracket generally designated 69 and including a forward flange 70 and a side flange 71. The forward flange 70 is secured to the riser 13 by means of bolt fasteners 73, and the inclined flange 71 may be welded to the support post 28.

In addition, a conventional locking mechanism for the wheel channels may be provided for locking the row sections in the expanded or use position, and this comprises, in the illustrated embodiment, a latch member 73 which is pivotally mounted at 74 to the post 28, and an angle bracket 75 welded to the forward portion of the wheel carriage 11 and having an inwardly extending portion. When the system is fully extended, the latch member 73 engages and locks with the angle bracket 75 of the next higher row section, the wheel carriage of which is located outwardly of the latch 73.

The system may also be provided with a cable alignment system such as the one disclosed in U.S. Pat. No. 3,667,171 for maintaining the rows in parallel alignment during expansion and retraction. The cable alignment system includes, for each post, a sheave 80 which is mounted for rotation about a vertical axis on a sheave bracket 81 which is secured to the post by welding to the flange 71 of the riser bracket 69. There are two alignment cables for each row section, and they are arranged in the manner disclosed in said patent.

Figure 9:
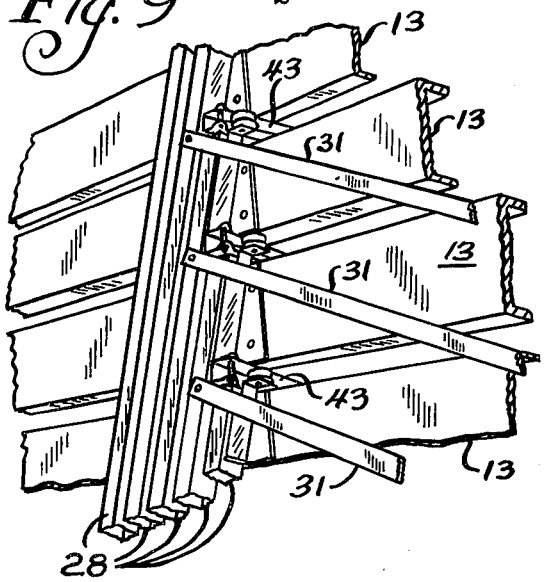
FIG. 9 is a lower-rear perspective view, taken from the right, of the left side of a row incorporating the present invention.

Referring now to FIGS. 9 and 11, it will be observed that in the retracted position, all of the left posts 28 are in nested relation, and the rear risers 13 are in vertical alignment. Similarly, the front risers 97 are vertically aligned (FIG. 11). FIG. 13 shows the lower rows of FIG. 12 in the open or use position for a bleacher seating system, the seat boards being denoted 98 and the tread panels 99.

The straps 31 are fastened to the associated post 28 at a location which is adjacent the cantilever arm 43 for that row section. However, as mentioned, the location at which the brace is secured is not critical, and it could even be attached directly to the riser 13 adjacent the riser-post connection. The function of the bracing is to form a triangularly-braced section with the brace, the post and a section of the riser. The more of the riser that is included, the greater bracing effect will result. It will be observed that the braces 31 take the form of flat steel straps in the illustrated embodiment. Such straps have little ability to bear compressive loads but are quite satisfactory under tension. This is different than the braces 21 of the FIG. 2*a* structure which, as indicated are compressive members because the prior art braces induce a bending moment in the riser under vertical load, whereas the location of the braces of the present invention is such as to avoid bending moments in the riser.

Figure 10:
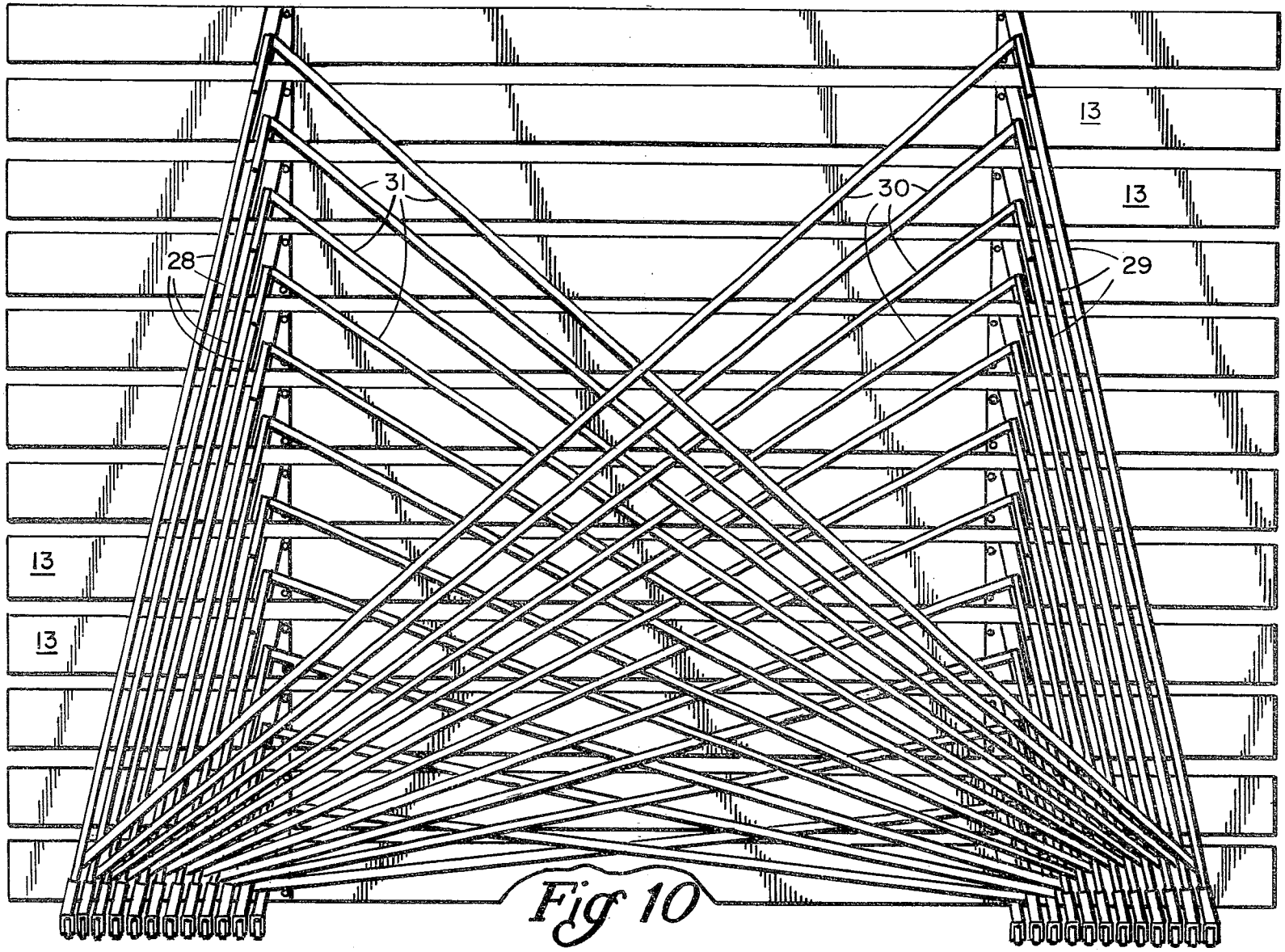
FIG. 10 is a rear view of a seating system showing a post and bracing pattern for a 12-row telescoping seating system constructed according to the present invention.
Figure 12:
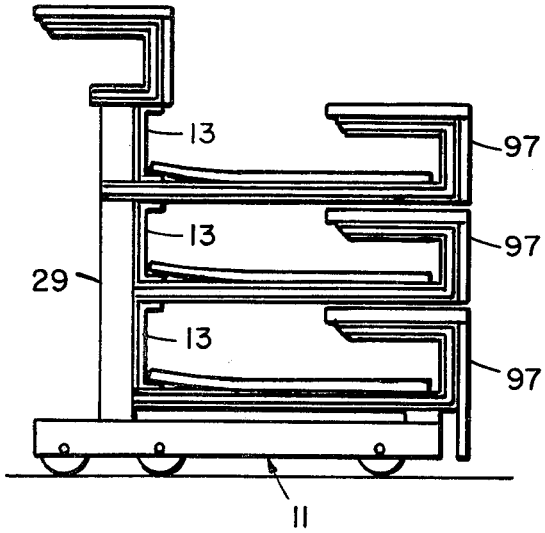
FIGS. 12 and 13 are fragmentary and side views of the lower rows of a telescoping bleacher system constructed according to the present invention in the retracted and extended positions respectively.
Figure 13:
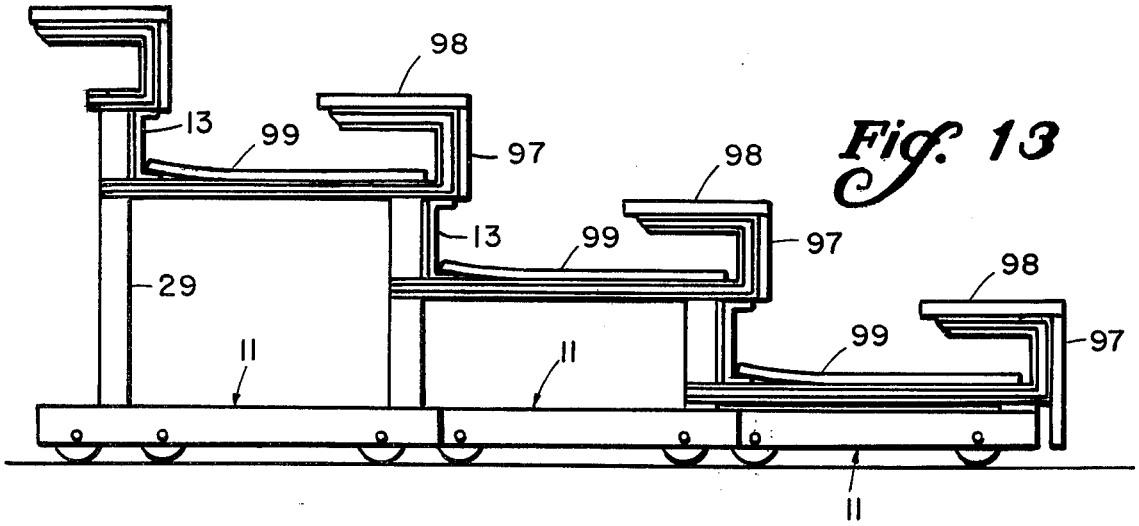

Referring now to FIG. 10, there is shown a rear view of a system of the type shown in FIGS. 12–13 including inclined side posts 27, 28 and the associated braces 30, 31. It will be observed that the locations at which the inclined braces are connected to the risers 13 are in vertical alignment, whereby the center span between riser/post connections is constant for each riser. As already indicated, another way to describe this feature of maintaining constant span is to say that the points of intersection of the axes of the posts 28 with the planes of their associated tread panels are vertically aligned. The posts 29 are similarly aligned with their tread panels. In this illustration, the center span is greater than twice the cantilever span.

In the illustrated embodiments of FIGS. 4, 5, 7–10, and 12–13, the main horizontal support element (i.e., the "deck means") for each row includes a riser; whereas, in FIG. 11, tread support frame and tread panel are integrated to provide the main horizontal support or deck means connected between the posts. The present invention is readily adaptable to such structures.

Having thus disclosed specific embodiments of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In a telescoping seating system having a plurality of row assemblies arranged for movement between a storage position in which the row assemblies are nested with support posts or columns laterally aligned, and a use position in which the row assemblies are extended from front to rear and in stepped relation, each row assembly comprising: a pair of laterally spaced floor-engaging carriage means, a post fixed to each carriage means and extending upwardly therefrom, deck means; means for connecting said deck means to a pair of posts for each row; said system characterized in that said posts are inclined relative to the vertical on each side of said system such that the center span between deck-/post connections for a plurality of said row assemblies is the same.

2. The system of claim 1 wherein said deck means comprises riser means including a beam, and wherein said connecting means directly connects said riser beam to a pair of posts for each row; the deck/post connections on each side of said system being vertically aligned when said system is in said retracted position, whereby the spacing of deck/post connection locations in said riser beams may be uniform for risers and cover materials.

3. The structure of claim 2 further comprising brace means interconnecting the lower portion of each post to a laterally spaced location on the upper portion of the same row assembly.

4. The system of claim 3 wherein said brace means comprises a pair of braces, each connected between the lower portion of one post of a row assembly to a location adjacent the deck/post connection of the other post in the same row and each brace comprises a tension member under vertical loading of said system.

5. The apparatus of claim 4 wherein said braces comprise flat steel straps.

6. The system of claim 2 wherein said seating system further comprises a plurality of arms connected to said riser means and extending outwardly thereof; and seat support means connected to the distal end of said arms.

7. The system of claim 1 wherein said deck means comprises riser means carried by said posts; a pair of cantilever arms connected respectively to the upper portions of said posts and extending outwardly thereof; a plurality of support arms connected to said riser means and extending outwardly thereof for supporting a tread panel; and a forward transfer member carried by the distal ends of said cantilever arms and said support arms, whereby said seating system is adapted for chair/-platform usage.

8. The system of claim 1 wherein said deck means if adapted for a low-rise seating system and comprises rigid frame means connected to said posts at the upper portions thereof by said connecting means; and tread panel means carried by said frame means.

9. In a telescoping seating system having a plurality of row assemblies arranged for movement between a storage position in which the row assemblies are in substantially nested relation, and a use position in which the row assemblies are arranged in stepped relation, the improvement wherein each row assembly comprises a pair of laterally spaced floor-engaging support means; a post fixed to each support means and extending upwardly and inwardly thereof; deck means extending between each pair of posts for supporting seating elements; and means for connecting each post to its associated deck means in substantial vertical alignment with the deck/post connections of adjacent row assemblies when said assemblies are in said storage position; whereby the center span between each pair of posts is the same for a plurality of said row assemblies.

10. In a telescoping seating system having a plurality of row assemblies each including support post and arranged for movement between a storage position in which the row assemblies are generally vertically aligned in nested relation, and a use position in which the row assemblies are arranged in stepped relation, the lengths of said posts being progressively shorter from an upper row assembly to a lower row assembly and said posts being arranged such that the lower row assemblies fit within the upper row assemblies when in nested relation, the improvement wherein each row assembly comprises a pair of laterally spaced posts extending upwardly and having the opposite ends thereof slanted in opposite directions with respect to each other; and horizontal support means extending between and connected to the upper portions of each pair of posts.

11. In a seating system having a plurality of row assemblies arranged for telescoping movement between a storage position in which the row assemblies are generally vertically aligned in nested relation, and a use position in which the row assemblies are arranged in stepped relation, each row assembly comprising at least a pair of laterally spaced lower-engaging carriage support means; a post carried by each carriage support means; the improvement characterized in that said posts extend upwardly and are slanted in opposite directions with respect to each other; horizontal deck means for supporting an occupant and extending between and spanning the upper portions of each pair of posts; and means for connecting the upper portion of each post to the associated deck member; the spanning distance between said posts of each row assembly being substantially equal and the length of said posts being progressively shorter from the top row assembly to the lower row assembly, whereby the posts of the lower row assemblies are in side-by-side relation within the upper row assemblies when in nested relation.

12. In a telescoping seating system having a plurality of row assemblies each having a pair of support posts and arranged for movement between a storage position and a use position, the improvement wherein each row assembly further includes an understructure comprising a carriage means for supporting each post; said posts comprising compressive members, all of said compressive members on a given side of said system being parallel and inclined at an acute angle relative to the horizontal; deck means for each row assembly; and connection means connecting a pair of posts for each row assembly to an associated deck means such that the center span for each assembly between deck/post connections is substantially constant for said plurality of row assemblies.

13. The system of claim 12 wherein said carriage means are spaced progressively outwardly for higher row assemblies and wherein said posts are inclined inwardly, the angle of inclination of said posts being determined by the rise of the system and by the lateral spacing of wheel carriages for adjacent row assemblies.

14. The system of claim 10 wherein said angle of inclination is defined as $\tan^{-1} r/a$ where $r$ is the row-to-row rise and $a$ is the center-to-center lateral spacing of adjacent wheel carriages in the storage position.

15. The system of claim 12 wherein each of said inclined compressive members defines an included angle with the horizontal in the range 75° – 82°.

16. The system of claim 15 wherein said included angle of inclination is approximately 78°.

17. In a seating system having a plurality of row assemblies arranged for movement between a storage position and a use position, the improvement wherein each row assembly includes floor-engaging support means and compressive support members comprising posts inclined at an included angle whose tangent is defined approximately as the rise of the system divided by the center-to-center lateral spacing of adjacent ones of said floor-engaging support means in the storage position.

18. In a seating system having a plurality of row assemblies arranged for telescoping movement between a storage position in which said rows are in nested relation and a use position in which said rows are in stepped relation, each row assembly comprising a pair of floor engaging carriage means, a pair of posts supported by and extending upwardly from said pair of carriage means respectively, each post defining a longitudinal axis; deck means for supporting occupants and including tread panel means defining a horizontal plane; and means for connecting said deck means to the upper portions of said posts, the improvement characterized in that for each row said pair of posts are inclined in opposite directions to define a predetermined angle with the horizontal such that for each side of the system, the intersections of the longitudinal axes of said posts with the horizontal plane of the associated tread panel means are in vertical alignment, whereby the center span between a pair of posts is uniform for said plurality of row assemblies.

19. A telescoping seating system comprising a plurality of row assemblies adapted for movement between a storage position in which the row assemblies are nested, and a use position in which the row assemblies are in stepped relation, each row assembly including at least first and second laterally spaced support means and deck means carried by said first and second support means, said first and second support means for each row assembly being spaced progressively further apart for adjacent rows and nesting to side-by-side relation in the storage position, the system characterized in that said deck means and said first and second support means are so constructed and arranged that each row of said plurality has a similar deck means/support means configuration such that the center span between said first and second support means is the same for all row assemblies.

20. The system of claim 19 wherein said deck means comprises a horizontal riser beam connected between the upper portions of said first and second support means, and wherein said first and second support means each includes connection means for connecting said riser beams to said first and second support means, said improvement being further characterized in that the connection between said riser beam and said first and second support means for each side of said system are in vertical alignment when said rows are in said storage position.

21. The apparatus of claim 19 wherein said first and second support means each comprise a post and a wheel carriage at the bottom of each post, each post on each side of said system extending upwardly and offset from a true vertical line through its associated wheel carriage.

22. The system of claim 21 wherein each of said posts is inclined inwardly, all of the posts on each side of said system being parallel and inclined at a uniform angle.

* * * * *

UNITED STATES PATENT OFFICE

CERTIFICATE OF CORRECTION

Patent No. 4,041,655 Dated August 16, 1977

Inventor(s) Vincent Anthony Pari

It is certified that error appears in the above-identified patent and that said Letters Patent are hereby corrected as shown below:

Column 10, line 40, change "if" to -- is --.

Column 10, line 62, change "post" to -- posts --.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*